United States Patent [19]

Dantoin, Jr.

[11] Patent Number: 4,911,288

[45] Date of Patent: Mar. 27, 1990

[54] CAN CARRIER

[76] Inventor: Kenneth R. Dantoin, Jr., 2222 E. Belleview, Apt. 309, Milwaukee, Wis. 53211

[21] Appl. No.: 394,022

[22] Filed: Aug. 15, 1989

[51] Int. Cl.[4] ..... B65D 73/00

[52] U.S. Cl. ..... 206/139; 206/161; 206/427

[58] Field of Search ..... 206/139, 145, 159, 161, 206/427

[56] References Cited

U.S. PATENT DOCUMENTS

| | | | |
|---|---|---|---|
| 2,735,631 | 2/1956 | Sexton | 242/139 |
| 3,227,271 | 1/1966 | Copping | 206/65 |
| 3,245,711 | 4/1966 | Dantoin | 294/87.2 |
| 3,302,783 | 2/1967 | Lyon | 206/65 |
| 3,307,692 | 3/1967 | Chidsey, Jr. | 206/65 |
| 3,358,828 | 12/1967 | Talaas | 206/65 |
| 3,404,912 | 10/1968 | Watts | 294/87.2 |
| 3,462,020 | 8/1969 | Hall | 211/13 |
| 3,664,496 | 5/1972 | Mascia | 206/159 X |
| 3,734,278 | 5/1973 | Kerrigan et al. | 206/65 S |
| 3,747,749 | 7/1973 | Brown | 206/65 C |
| 3,750,874 | 8/1973 | Detzel et al. | 206/65 E |
| 3,959,949 | 6/1976 | Benno et al. | 53/35 |
| 4,033,457 | 7/1977 | Weaver | 206/390 |
| 4,185,744 | 1/1980 | Peterson | 206/427 |
| 4,191,290 | 3/1980 | Suffern | 206/139 X |
| 4,216,859 | 8/1980 | Bader et al. | 206/159 |
| 4,296,858 | 10/1981 | Platt | 206/139 X |
| 4,465,180 | 8/1984 | Klygis | 206/158 |
| 4,560,064 | 12/1985 | Peterson et al. | 206/159 |
| 4,741,729 | 5/1988 | Edwards | 493/339 |

*Primary Examiner*—William Price

*Attorney, Agent, or Firm*—Quarles & Brady

[57] ABSTRACT

A carrier to make a package of sealed cans is a flat sheet having a slot opening for each can. Each can has a tab fixed to its lid. The tabs are nested in the slots with the edges of the slots between the tabs and the lids. Frictional resistance between the cans and the carrier is sufficient to retain the cans in the carrier. A locking tongue can also be provided in the carrier to catch behind the tab for further assurance against retrograde movement. Moreover, the carrier can be made so that it dishes inside each can rim which enhances the strength and holding ability of the carrier.

20 Claims, 5 Drawing Sheets

FIG. 3
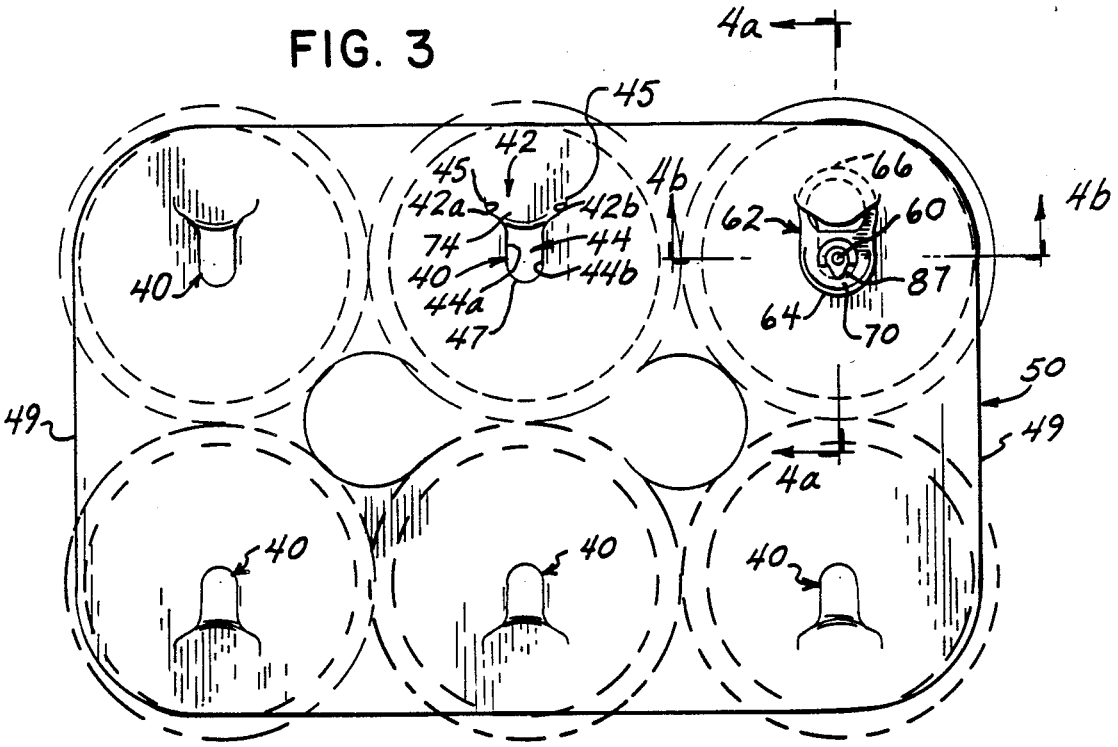
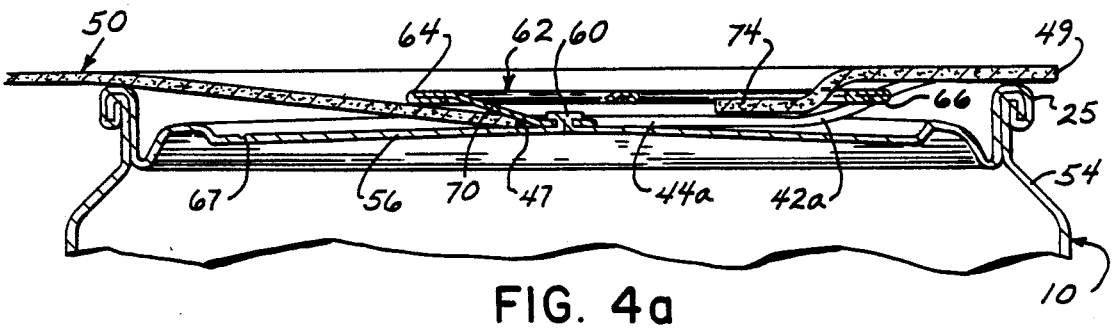
FIG. 4a
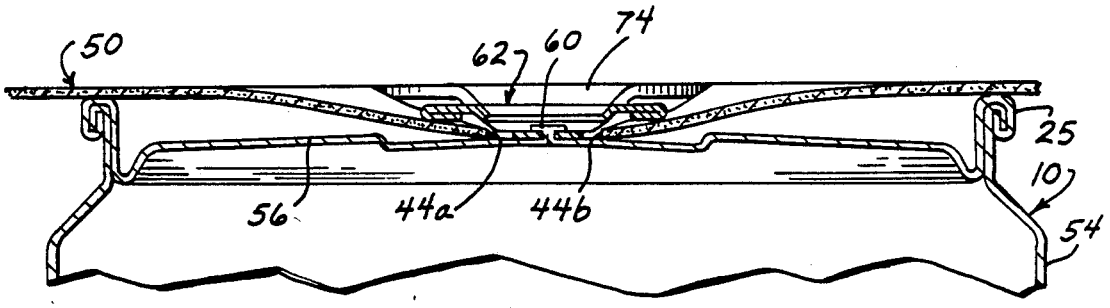
FIG. 4b

FIG. 5
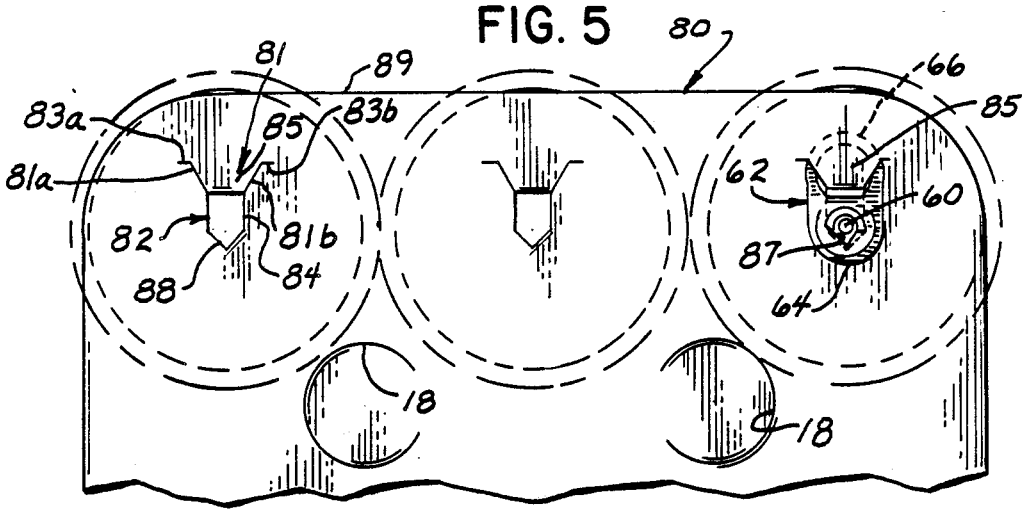
FIG. 6a.
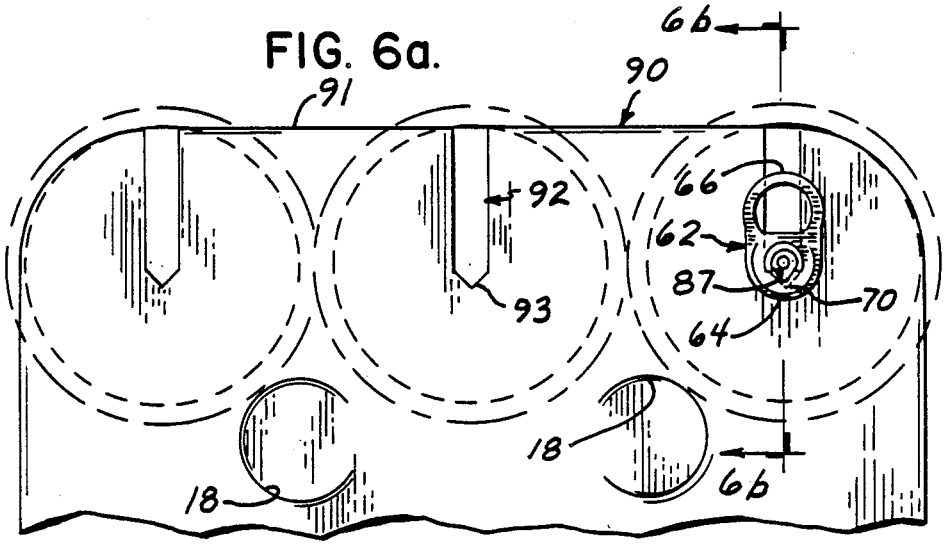
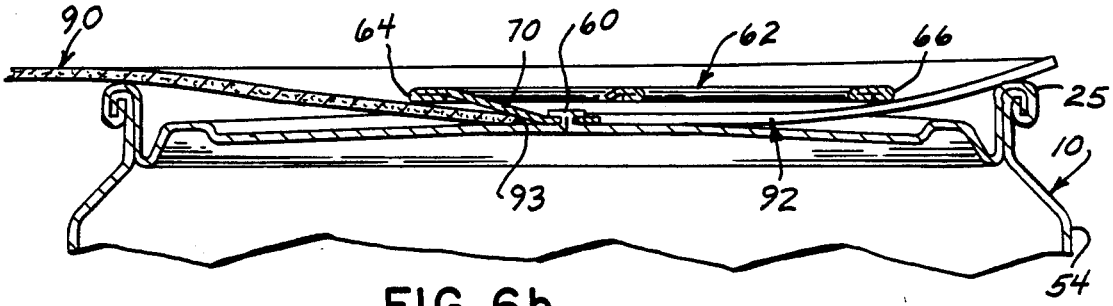
FIG. 6b

FIG. 7a
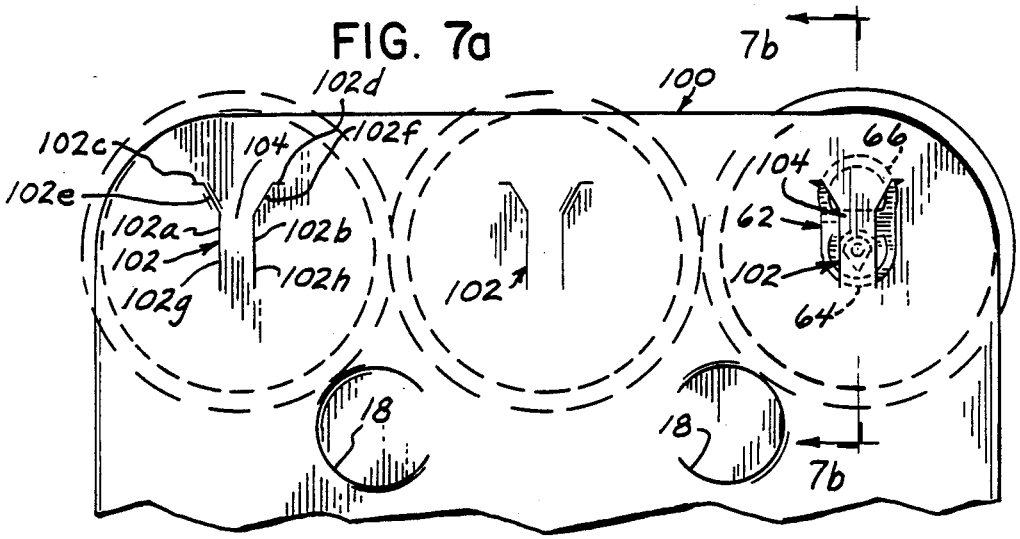
FIG. 9
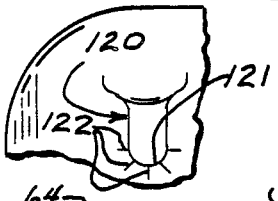
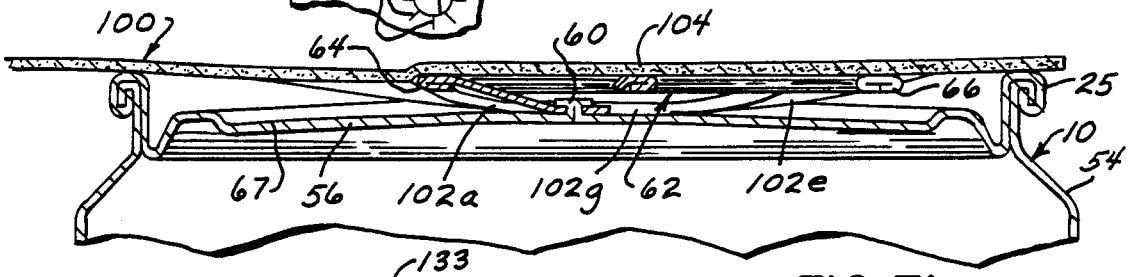
FIG. 7b
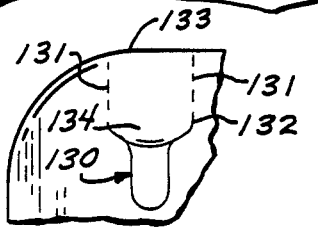
FIG. 10
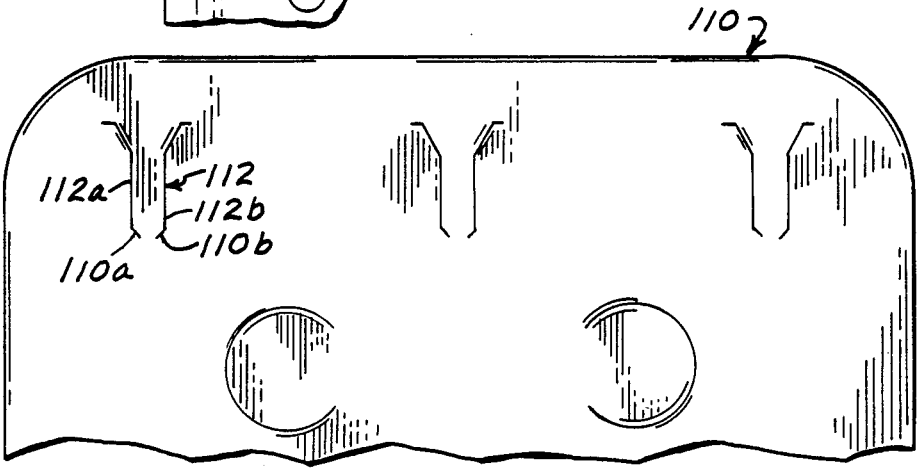
FIG. 8

CAN CARRIER

FIELD OF THE INVENTION

This invention relates to a package for carrying multiple cans of the type having a pull-tab type top.

BACKGROUND OF THE INVENTION

Cans having pull-tab tops are well known for packaging many liquid products such as beer and soda. The can typically has a pull-tab riveted to its top which can be raised and thereby used as a lever to shear away a portion of the top along a score line, thereby opening the can.

These cans typically have a rim around their top which extends slightly from the side of the can. This rim has been advantageously employed in prior plastic yoke-type packages to hold the cans in groups, typically in multiples of six, and also as a carrier for the cans. The plastic yoke-type packages had one plastic ring for each can. Each ring was stretched tightly around the can just below the top rim. Friction between the ring and the can and the interference between the rim and the tightly fitting ring maintained the cans in the package.

However, the plastic yoke-type carriers have a number of disadvantages. The plastic yoke-type carriers, once made and used, are difficult to dispose of. They are not biodegradable and are also not economically recycleable. If not properly disposed of, the yoke-type carriers pose a serious danger to wildlife, which can become entangled in the yokes and perish.

The yoke-type carries also have a relatively high material cost, usually being made of a rather thick polyethylene sheet. They also do not provide protection to the can tops against contamination, since the can tops are not covered. Moreover, the yoke-type carriers do not provide any significant "billboard" space with which to print any desired advertising or other information.

SUMMARY OF THE INVENTION

The present invention provides a carrier for two or more sealed cans of the type having a tab fixed by securing means to a lid of each can. A sheet for holding the cans has slot openings spaced apart by the center-to-center distance between the cans. Each slot opening is adapted to receive the tab of one sealed can with the edges of the sheet around each slot being frictionally engaged between the tab and the lid in an interference fit. This provides a carrier which can be made of paper board which is biodegradable and thus environmentally safe. The carrier can also be inexpensively made and is readily adaptable to automated packaging processes for assembling cans to the carrier. Moreover, the carrier can be made to cover the tops of the cans to protect them from contamination and provide a printable surface for labelling or other information.

In a preferred form, the carrier is flat and deformable to engage each tab in a slot. The cans are typically of the type which have an upstanding rim around the lid and above the level of the tab. The sheet is sized and shaped to cover each rim and the area of the sheet inside of each rim is deformable so that it can be dished to receive a tab in each slot. This dishing is desirable because it enhances the strength and holding ability of the carrier.

The foregoing and other objects and advantages of the invention will appear from the following description. In the description, reference is made to the accompanying drawings which form a part hereof, and in which there is shown by way of illustration a preferred embodiment of the invention. Such embodiment does not necessarily represent the full scope of the invention, however, and reference is made therefore to the claims herein for interpreting the scope of the invention.

BRIEF DESCRIPTION OF THE DRAWINGS

FIG. 3 is a top elevation view of a second embodiment of a carrier of the invention;

FIG. 4*a* is a cross sectional view taken along the plane of the line 4*a*—4*a* of FIG. 3;

FIG. 4*b* is a cross sectional view taken along the plane of the line 4*b*—4*b* of FIG. 3;

FIG. 5 is a partial top plan view of a third embodiment of a carrier of the invention;

FIG. 6*a* is a partial top plan view of a fourth embodiment of a carrier of the invention;

FIG. 6*b* is a cross sectional view taken along the plane of the line 6*b*—6*b* of FIG. 6*a;*

FIG. 7*a* is a partial top plan view of a fifth embodiment of a carrier of the invention;

FIG. 7*b* is a cross sectional view taken along the plane of the line 7*b*—7*b* of FIG. 7a;

FIG. 8 is a partial top plan view of a sixth embodiment of a carrier of the invention;

FIG. 9 is a partial top plan view of a seventh embodiment of a carrier of the invention;

FIG. 10 is a partial top plan view of an eighth embodiment of a carrier of the invention;

DETAILED DESCRIPTION OF THE PREFERRED EMBODIMENT

Figure 1:
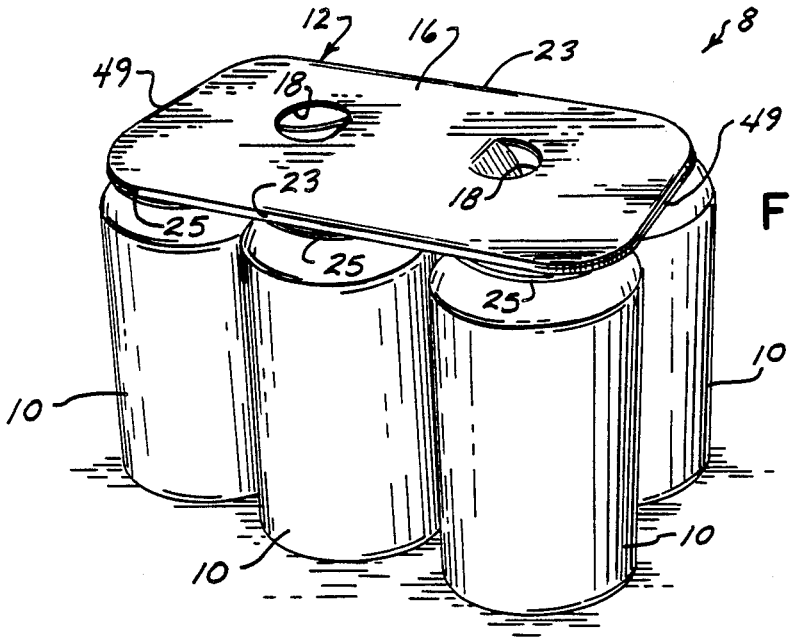
FIG. 1 is a perspective view of a package using a carrier of the invention.

FIG. 1 illustrates a "six pack" package 8 of cans 10 made using a carrier 12 of the present invention. As shown in FIG. 1, the top panel 16 of the carrier 12 is flat except for finger holes 18 and is suitable to be used as an advertising panel to bear advertising, trade or other indicia. Also as shown in Fig. 1, the carrier 12 completely overlies the tops of all six cans 10. As will become apparent from the following description, a carrier 12 of the present invention could be made to accommodate any number of cans. The arrangement of cans, however, is preferably symmetrical.

Figure 2:
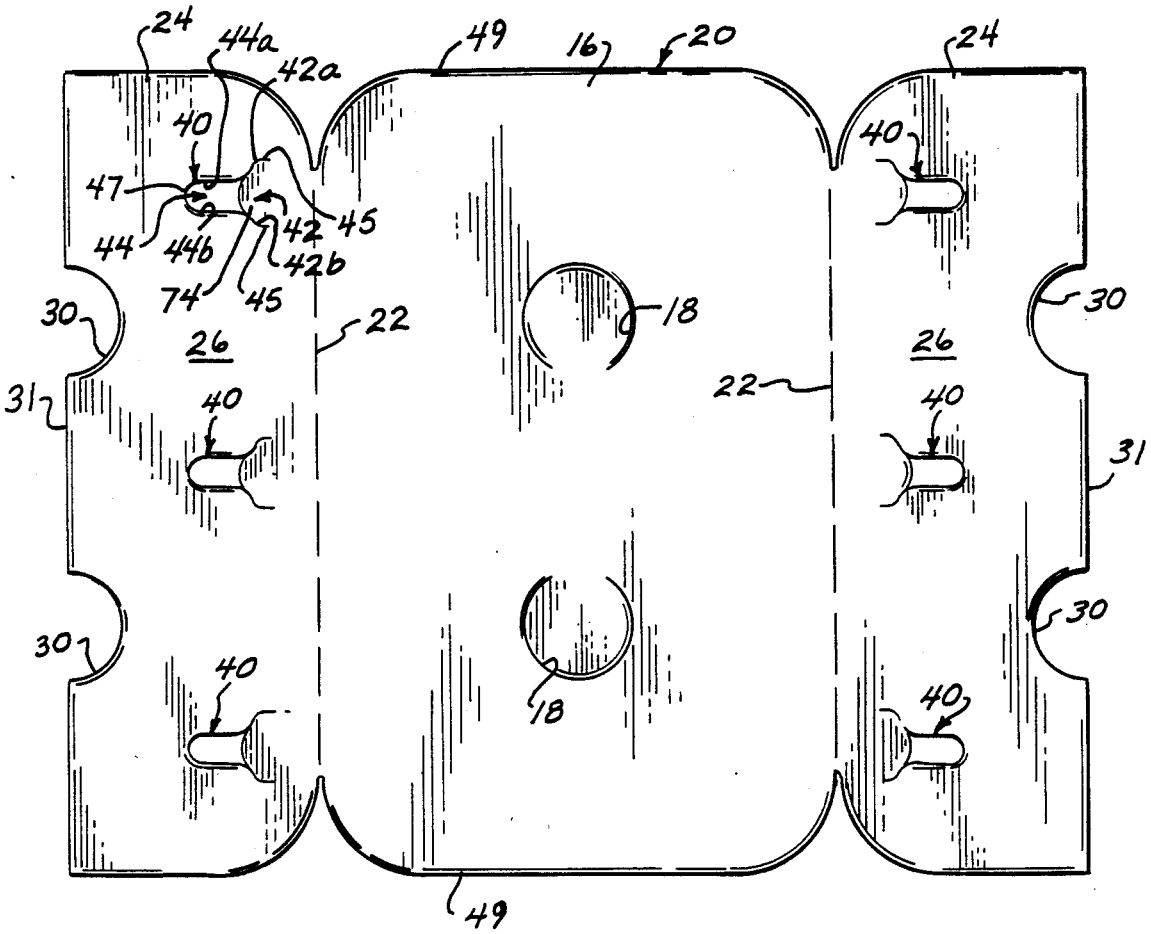
FIG. 2 is a top elevation view of an unfolded blank for the carrier of FIG. 1.

FIG. 2 illustrates a blank 20 used to make the carrier 12. In the finished state shown in FIG. 1, the carrier 12 is a two-ply sheet because the blank 20 is fold along fold lines 22 (FIG. 2), which are coincident with longitudinal edges 23 of the carrier 12 shown in FIG. 1. The cans 10 are preferably inserted into the carrier, as will later be described, before the blank 20 is folded along fold lines 22 or while the blank 20 is being folded. As can be seen, the blank 20 has the top panel 16 inside of the fold lines 22 and a wing 24 outside of each fold line 22. If the wings 24 are folded away from the reader along the fold lines 22, the cans would be assembled to the blank 20 with their rims 25 against surfaces 26, which are the surfaces facing the reader in FIG. 2. The wings 24 would then be folded, or completed being folded, and the undersurfaces of the wings 24, which are opposite from the surfaces 26, would be glued or otherwise appropriately secured to the facing undersurface of the panel 16 to complete the carrier 12.

In FIG. 2, the finger holes 18 are formed by open circular cuts, with the open portions facing inwardly toward each other so that the remaining material inside the cuts can be folded downwardly between the cans 10 to grasp the carrier 12. The leftover flaps from the finger hole 18 are folded downwardly into the interstitial spaces between the adjacent end two cans and the middle two cans (see FIG. 3). Note also that in the blank 20 semicircular holes 30 are provided along the outside longitudinal edges 31 of the wings 24 to provide clearance for the finger holes 18.

The blank 20 has a slot opening 40 for each can 10. The slots 40 are spaced apart longitudinally and transversely by the center to center distance between the cans 10 when the blank 20 is folded into the carrier 12 and with adjacent cans 10 abutting one another in side by side relation. Each slot 40 defines a mouth 42 adjacent its outward end 45 ("outward" and "inward" refer to the respective outward or inward directions when the carrier is completed, i.e. for the carrier 12, after the blank 20 is folded) and a throat 44 which is inward from the mouth 42. Edges 44*a* and 44*b* of the throat 44 meet and coterminate at an inward end 47 of the slot 40. Opposed cuts 42*a* and 42*b* which define each mouth 42 extend inwardly from end 45 toward the throat 44 and toward one another in the direction of the throat 44 so that the mouth 42 tapers towards the throat 44. The throat 44 is of a comparatively constant width which is sufficient to engage the top of a can 10 as described below.

It should be noted that a blank for a two ply carrier of the invention such as the carrier 12 could be made in many different ways. For example, The fold lines 22 could be positioned along end edges 49 of the panel 16 or there could be only one fold line 22 along one edge of the panel 16. Also, the slots 40 could be positioned inside the panel 20, with the panels 24 having no slots. In that case, the panels 24 would be on top of the carrier in the finished package. Also, a construction could be provided in which slots were provided in a central panel, and side panels folded down along the sides of the cans to provide advertising space. Moreover, such side panels could also be made to help hold the cans in the package, for example, by providing a cutout for each can in the side panels to engage beneath the rim of the can.

A carrier 50 of the invention made from a single ply of material and having slots 40 identical to the slots 40 in the first embodiment 12 described above is illustrated in FIG. 3. Finger holes 18 are also provided in the carrier 50. The carrier 50 also has longitudinal edges 23 and end edges 49 and is the same shape as the carrier 12 (after the blank 20 is folded).

The carriers 12 and 50 are preferably made of a cardboard or paperboard material which is suitably strong and flexible. Thirty point (0.030" thick) natural kraft paperboard has been found suitable, which may be coated for printing or uncoated. This type of paperboard has been popular as boxboard for beverage carriers. However, although cardboard or paperboard or other biodegradable material is preferable for making carriers of the invention, carriers of the invention could be made from many types of sheet material having the requisite strength, handling and flexibility properties. For example, plastic, fiberglass, or metal could be used.

The cans 10 should preferably be arranged in the package 8 so that they are closely adjacent or touching one another. It is also preferred that they be arranged symmetrically relative to the finger holes 18. Thereby, when the package 8 is lifted by the finger holes 18, they tend to rotate toward one another about a horizontal axis (i.e., the bottoms of the cans move toward one another) and offset each other's rotation. It should also be noted that lifting the package 8 tends to bend the carrier along an axis through the centers of the finger holes 18. This bending is limited by the offsetting rotation of the cans mentioned above and serves to strengthen the carrier against bending in the direction transverse to the direction of the axis through the finger holes 18.

Referring to FIGS. 3, 4*a* and 4*b*, each can 10 has tubular sides 54 and a lid 56 closing off the top end of the can. The lid 56 is joined to the sides 54 in well known fashion which forms the top rim 25. A rivet 60 is formed in approximately the center of the lid 56 and attaches a tab 62 to the lid 56. The tab 62 has a toe end 4 and a heel end 66. In well known fashion, a user can lift up on the heel end 66 which causes the toe end 64 to pry downwardly against the rim 56 and break the seal (indicated by notch 67 in FIG. 4*a*) of the can 10 so that the can's contents can be consumed. As shown in FIGS. 4*a* and 4*b* the entire tab 62 of a sealed can 10 is beneath the top of the rim 25.

To insert a can 10 into one of the slots 40, the can 10 is first aligned so that the longitudinal axis (see line 4*a*—4*a* of FIG. 3) of the tab 62 and of the slot 40 are aligned. The edges of the slot 40 are then guided beneath the tab 62 as the can 10 is moved inwardly toward the slot 40 relatively to the carrier. The mouth portion 42 of the slot 40 facilitates the initial guiding of the sheet material of the carrier around the slot 40 beneath the tab 62 and the narrowing of the slot 40 in the throat 44 tightens the grip of the sheet material on the can 10. When the inner end 47 of the throat 44 becomes pinched between an inclined strap 70 (FIG. 4*a*) of the tab 62 and the lid 56, the tab 62 has been moved far enough into the slot 40 to secure the can 10 to the carrier. This process may be done manually or could readily be adapted to be performed by an automatic machine.

Figure 12:
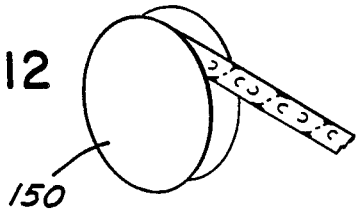
FIG. 12 is a view of a bulk package for carriers of the invention.

Feeding carriers of the invention continuously end to end from a roll on a spool 150 as shown in FIG. 12 may be advantageous. This provides registration between cans and carriers which is often important in packaging, especially if the packaging process is automated. Such roll type packaging of the carriers also has advantages in shipping and handling of the carriers. After cans are put into packages using carriers of the invention, the ends of the carriers could be cut so as to separate the packages.

Each slot 40 receives a tab 41 (FIGS. 3, 4*a*, 4*b*) of a sealed can 10 with the top and bottom surface areas of the carrier 12 around the edges 44*a* and 44*b* of the slot 40 being frictionally engaged between the tab 41 and the can lid 56 in an interference fit. One advantage of using paperboard for a carrier of the invention is that it has a relatively high coefficient of friction against the surfaces of the tab 62 and lid 56. Paperboard is relatively compressible and fibrous to provide a high coefficient of friction between it and the lid 56 and tab 62 to hold a can 10 in the soot 40 securely. Its compressible nature allows it to be pinched by the tab 62 without deforming the tab 62 which adds to the holding force exerted by the carrier on the can 10.

It is especially desirable to insert cans into the slots 40 with the toe end 64 leading. In this orientation, the toe end 64 of the tab is lifted by the sheet material of the carrier and there is no tendency to open the can. Otherwise, if the heel end 66 were to be inserted first into the slot 40, the heel end 66 would be lifted by the sheet material with the possibility of pressing the toe end 64 against the lid 56 which could conceivably break the seal 67 under some circumstances. Thus inserting the toe end 64 of the tab 62 first insures against any unintentional opening of the can 10.

One important aspect of the invention is that the area of the carrier inside of the rim 25 of each can 10 dishes. This is caused by each slot 40 being pulled down beneath the level of the tab 62 as the can 10 is slid into the slot 40 while the rim 25 holds the outlying areas of the carrier above the level of the tab 62. This dishing is a highly desirable feature which enhance the strength of the carrier. The dishing also helps retain the cans within the carrier since the carrier is dished down inside the rims of the cans to create additional resistance to retrograde movement of the cans.

Although the frictional resistance between the carrier 12 or 50 and the cans 10 is sufficient under most circumstances to hold the cans securely in the carrier, a locking tongue 74 may be provided to further insure against any accidental removal of the cans 10 from the carrier. Referring to FIGS. 2, 3, 4*a* and 4*b*, the locking tongue 74 is the remaining sheet material in the mouth area 42 of the slot 40. After the can 10 is slid into the slot 40, the tongue 74 may be bent or folded downwardly as shown in FIG. 4*a* so as to further impair retrograde movement of the can 10 out of the slot 40.

Figure 11:
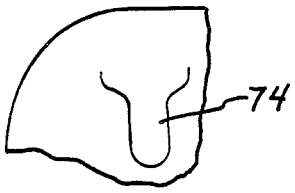
FIG. 11 is a partial top plan view of a ninth embodiment of a carrier of the invention.

As noted, friction alone may be sufficient to retard retrograde can motion in some applications. In those applications, it may be preferred to allow the tongue 74 to extend all the way up to the end 47 of the slot 40 and generally fill up the slot 40 as shown in FIG. 11. This would allow substantially continuous graphics spanning the slot 40 as in the embodiments of FIGS. 7*a* and 8 described below.

FIG. 5 illustrates a third embodiment 80 of a carrier of the invention. This embodiment is identical to that of FIG. 3 except that the slots are of a different shape. The slots 82 of the carrier 80 have a mouth portion 81 defined by cuts 81*a* and 81*b* and a throat portion 84. An end 88 of the throat portion 84 comes to a point in the center and is angled outwardly toward the outer edge 89 of the carrier 80. The angling of the end 88 conforms more closely with a bend line 87 of some types of tabs 62 as shown on the right end of FIG. 5. This provides a longer edge of sheet material to be pinched between the tab 62 and lid 56 of each can 10 at the end 88 of the slot 82 than does the rounded end 47 of the slot 40.

The slot 82 also has a tongue 85 which acts in the same manner as the tongue 74 of the slot 40. In addition, the cuts 81*a* and 81*b* have end portions 83*a* and 83*b* which extend at approximately 90° to the longitudinal axis of the slot 82 and therefore of the tab 62. These cuts 83*a* and 83*b* provide further insurance against accidental opening of a can 10. If the carrier 80 is made out of cardboard, as is preferred, pulling the heel end 66 of the tab 62 away from the carrier 80, such as may occur if the can 10 were pulled downwardly away from the carrier 80 or if the can's bottom were rotated inwardly about a horizontal axis, the cuts 83*a* and 83*b* will facilitate tearing of the carrier 80 rather than opening of the can 10. In addition, cuts 83*a* and 83*b* may serve additional purposes of providing a "scissors" effect on the tab to help hold the can in the carrier and of facilitating assembly of the carrier to cans by allowing the carrier to initially deform more readily upon insertion of a can to the slot.

FIGS. 6*a* and 6*b* illustrate a fourth embodiment 90 of a carrier of the invention. The carrier 90 has a slot 92 of a constant width from the outer edge 91 of the carrier 90 inwardly far enough to where the rim 25 of each can 10 is covered by the carrier 90. The slot 92 has an inward straight-sided, angled end 93 like the end 88 of the slot 82. While the carriers 12, 50 and 80 have the advantage that the slot openings 40 and 82 have a closed perimeter, i.e., the slots 40 and 82 are completely encompassed by sheet material, slots such as the slots 92 may be useful in some applications where the carrier 90 is strong enough to support the cans 10 without the slots being completely encompassed by sheet material. In this regard, it should be noted that in the carriers 12, 50 and 80, the sheet material enclosing the outward ends of the slots keeps the slots 40 and 82 from opening which materially enhances the strength of the carriers.

FIGS. 7*a* and 7*b* disclose a fifth embodiment of a carrier 100 of the invention. The carrier 100 has slots 102 defined between two adjacent cuts 102*a* and 102*b*. The opening 102 is generally in the form of the opening 82 of the carrier 80 except that the cut 102*a* and 102*b* do not meet in the carrier 100 and no portion of the sheet is removed between the cuts 102*a* and 102*b*. However, the cuts 102*a* and 102*b* do include relief cuts 102*c* and 102*d* which operate similarly to cuts 83*a* and 83*b* in the carrier 80. The cuts 102*a* and 102*b* also include cuts 102*e* and 102*f* which define a mouth portion of the opening 102 and cuts 102*g* and 102*h* which define a throat portion of the opening 102. A bridge 104 of sheet material spans the slot 102 from its outward end to its inward end. It should be noted here that the throat portion is approximately 5/16 of an inch wide and that the widest distance between the cuts 102*e* and 102*f* in the mouth portion is approximately $\frac{5}{8}$ of an inch. These dimensions apply to all of the embodiments described herein.

In the carrier 100, there is no wedging of the material at the inner end of the cut beneath the strap 70 of the tab 62 as in the previously described embodiments. All of the force which holds cans 10 in the carrier 100 is provided by the sheet material along the sides of the cuts 102*a* and 102*b* and also by the bridge 104 of sheet material which spans the opening 102 from its outward end to its inward end. This arrangement has also been found to provide a sufficient frictional fit of the cans 10 to the carrier 100 to fix the cans in the carrier 100 under most circumstances. It should be noted that the carrier 100 dishes beneath the rim 25 more so in the direction transverse to the longitudinal axis (the longitudinal axis is in the direction of line 7*b*—7*b* of FIG. 7*a*) of the tab 62 than in the direction of the axis.

FIG. 8 illustrates a sixth embodiment 110 of a carrier of the invention having openings 112 defined by cuts 112*a* and 112*b* in a manner similar to the cuts 102*a* and 102*b* of the carrier 100, previously described. The only addition is that the inner end of the cuts 112*a* and 112*b* have relief cuts 110*a* and 110*b*. These cuts provide a more positive stop against the toe end 64 of a tab 68 as the tab is moved inwardly through the slot 112. Otherwise, the toe end 64 may tend to further tear the inner ends of the cuts 102*g* and 102*h* in the embodiment 100.

FIG. 9 is a fragmentary view of a carrier similar to the carrier 50. The slot 120 shown in FIG. 9 corresponds in location to the upper left hand slot shown in FIG. 3. However, the slot 120 shown in FIG. 9 also has cuts 122 extending radially outwardly rom the end 121 of the slot. In the previous embodiments, the normal means for removing a can 10 from the carrier was to reverse the assembly process, i.e., pull the can 10 outwardly along the longitudinal axis of the slot. However, with the slots 120 as shown in FIG. 9, the relief cuts 122 would allow a can to be pulled straight downwardly away from the carrier thereby ripping the carrier to release the can.

FIG. 10 illustrates yet another slot 130 similar to the slot 40 of the carrier 50. However, the slot 130 of FIG. 10 additionally has discontinuous perforation cuts 131 extending from the end of the mouth 132 of the slot 130 to the adjacent outward edge 133 of the carrier. The perforations 131 allow ripping the tongue 134 out of the carrier prior to removing a can 10 from the carrier. This would facilitate removal of the cans 10 from the carrier for consumption.

Numerous modifications to the embodiments described will be apparent from the foregoing description and drawings. However, it is not intended that the invention be limited to the embodiments described but should be defined by the claims which follow.

What is claimed:

1. A carrier for two or more sealed cans of the type having a tab fixed by securing means to a lid of each can, comprising a sheet having slot openings spaced apart by the center-to-center distance between the cans, each slot opening being adapted to receive the tab of each sealed can with the edges of the sheet around each slot being frictionally engaged between the tab and the lid in an interference fit.

2. A carrier as in claim 1, wherein said sheet is flat and deformable to engage each tab in a slot.

3. A carrier as in claim 1, wherein the cans are of the type which also have an upstanding rim around the lid and above the level of the tab, wherein the sheet is sized and shaped to cover each rim and the area of the sheet inside of each rim is deformable so that it can be dished to receive a tab in each slot.

4. A carrier as in claim 1, wherein each slot opening has a closed perimeter.

5. A carrier as in claim 4, wherein the sheet has perforations to allow tearing away a portion of the perimeter of a slot.

6. A carrier as in claim 1, wherein an edge of each slot is perforated to allow removing a can from the slot by pulling a can way from the slot in a direction transverse to the plane of the carrier.

7. A carrier as in claim 1, wherein the sheet comprises one or more primary panel portions in which the slot openings re formed and one or more secondary panel portions, said primary and secondary panel portions being foldable relative to one another to position the primary and secondary panel portions opposite from one another.

8. A carrier as in claim 1, wherein the sheet has symmetrically disposed finger holes for grasping the carrier.

9. A carrier as in claim 8, wherein each finger hole is positioned over an intersection between two or more cans.

10. A carrier as in claim 9, wherein the carrier will bend along a line through the fingerholes when the carrier is suspended from the finger holes.

11. A carrier as in claim 1, wherein the slot opening is formed by two adjacent cuts, each said cut extending inwardly away from an outside edge of the sheet and toward the other said cut adjacent to the outside ends of the cuts.

12. A carrier as in claim 11, wherein the cuts meet and at least a portion of the sheet between the cuts is removed.

13. A carrier as in claim 12, wherein a portion of the sheet remains between the cuts and spans the slot opening.

14. A carrier as in claim 1, wherein the slot opening has an outward end and an inward end, a mouth adjacent its outward end, and a throat inward from the mouth, said mouth tapering toward the throat and said throat being of a width to engage a can between the tab and the lid on both sides of the tab with the securing means at the inside end of said throat.

15. A carrier as in claim 14, wherein said sheet has a tongue for each slot, said tongue overlying each mouth portion and being adapted to be engaged with an outwardly facing surface of the tab to lock the tab in the slot opening.

16. A carrier as in claim 1, wherein the sheet is made of paper board.

17. A carrier as in claim 1, wherein said carrier is attached end to end to other such carriers.

18. A package of sealed cans comprising:

two or more sealed cans, each can having a lid, an upstanding rim around the lid, and a tab for opening the lid fixed to the lid below the level of the rim; and a carrier for holding said cans by the tabs thereof, said carrier comprising a generally flat sheet having slot openings therein spaced apart by the tab to tab distance between the cans, each slot opening being sized and shaped to receive the tab of each can with the top and bottom surface areas of the sheet adjacent the edges of the sheet around each slot engaged between the tab and the lid beneath the rim.

19. The package of claim 18, wherein the tab has a toe end for prying the lid open and a heel end for grasping by the user and the cans are inserted into the slots of the carrier with the toe end of the tab first into the slot.

20. The package of claim 19, further comprising a tongue portion of the sheet to catch behind an outwardly facing surface of the tab after the can has been inserted into the carrier.

* * * * *